US006126786A

United States Patent [19]

White et al.

[11] Patent Number: 6,126,786

[45] Date of Patent: Oct. 3, 2000

[54] APPARATUS AND METHOD OF GENERATING STOCK TURBULENCE IN A FOURDRINIER FORMING SECTION

[76] Inventors: James D. White, 5 Terry La., Belchertown, Mass. 01007; Douglas R. McPherson, 4 Metacomet Dr., East Granby, Conn. 06026; Richard E. Pitt, R.R. #3, Almonte, Ontario, Canada, K0A 1A0

[21] Appl. No.: 09/290,898

[22] Filed: Apr. 14, 1999

Related U.S. Application Data

[63] Continuation-in-part of application No. 09/099,356, Jun. 18, 1998, abandoned.

[51] Int. Cl.[7] ..... D21F 1/54; D21F 1/52

[52] U.S. Cl. ..... 162/209; 162/211; 162/350; 162/352

[58] Field of Search ..... 162/352, 374, 162/350, 351, 209, 211, 217

[56] References Cited

U.S. PATENT DOCUMENTS

| | | | |
|---|---|---|---|
| 2,928,465 | 3/1960 | Wrist . | |
| 3,337,394 | 8/1967 | White et al. . | |
| 3,573,159 | 3/1971 | Sepall . | |
| 3,598,694 | 8/1971 | Wiebe . | |
| 3,874,998 | 4/1975 | Johnson . | |
| 3,922,190 | 11/1975 | Cowan . | |
| 4,140,573 | 2/1979 | Johnson . | |
| 4,420,370 | 12/1983 | Saad . | |
| 4,687,549 | 8/1987 | Kallmes . | |
| 4,789,433 | 12/1988 | Fuchs . | |
| 4,838,996 | 6/1989 | Kallmes . | |
| 4,999,086 | 3/1991 | Marx, Jr. . | |
| 5,011,577 | 4/1991 | Hansen et al. . | |
| 5,089,090 | 2/1992 | Hansen . | |
| 5,643,417 | 7/1997 | Hanaya | 162/350 |
| 5,681,430 | 10/1997 | Neun et al. . | |
| 5,830,322 | 11/1998 | Caram et al. | 162/209 |
| 5,922,173 | 7/1999 | Neun et al. | 162/352 |

FOREIGN PATENT DOCUMENTS

| | | | |
|---|---|---|---|
| 10225 | 4/1930 | United Kingdom | 162/350 |

*Primary Examiner*—Karen M. Hastings
*Attorney, Agent, or Firm*—Robert A. Wilkes

[57] ABSTRACT

A method and apparatus for generating turbulence in stock to deflocculate the stock in an open surface forming section of a paper making machine comprises a dewatering box providing vacuum assisted drainage and which has a set of dewatering elements that impart turbulence into relatively thick stock layers carried at machine operating speeds of equal up to about 400 m/min, for the production of paper products having a basis weight generally in excess of about 160 gsm. Each set of elements includes a lead-in element, at least one intermediate element, and a trailing element. The path of the forming fabric is deflected downwardly as it passes over the intermediate elements, which are inclined at an angle of from about 0.25° to about 10° from a plane defined by forming fabric supporting surfaces on the lead-in and riser elements. This vertical movement initiates turbulence and agitation in the stock, which acts both to deflocculate the stock and to diminish the possibility of sheet sealing. The apparatus is useable in combination with other known formation and drainage devices which are located either upstream or downstream to augment their performance with thicker, slower moving stock layers.

50 Claims, 10 Drawing Sheets

APPARATUS AND METHOD OF GENERATING STOCK TURBULENCE IN A FOURDRINIER FORMING SECTION

This application is a continuation-in-part of application Ser. No. 09/099,356 filed Jun. 18, 1998 now abandoned.

FIELD OF THE INVENTION

The present invention relates to an apparatus and method for generating stock turbulence in the forming section of an open surface paper making machine. More specifically, the present invention relates to an apparatus and method for generating sufficient turbulence in the stock layer of an open surface forming section of a papermaking machine to assist in deflocculating a relatively thick stock layer carried on a relatively slowly moving forming fabric. This invention thus finds application in the manufacture of relatively heavy paper, pulp and board products. Further, the apparatus can be adjustable, so that the amount of turbulence imparted into the stock layer may be controlled and optimized to suit the grade of product being made.

BACKGROUND OF THE INVENTION

In a conventional open surface forming section, an aqueous stock, containing both paper making fibers and other paper making solids in amounts of from about 0.1% to about 1.5% by weight, is fed from a headbox slice onto a horizontal moving forming fabric. In such a forming section, after receiving the stock from the headbox slice, the moving forming fabric is supported by a forming board, followed by a series of drainage boxes. The drainage boxes commonly include dewatering devices such as blades and foils mounted on the drainage box in contact with the machine side of the forming fabric. In some modern slow speed machines table rolls are also still used as dewatering and turbulence generating devices. The forming section can also include other devices intended to generate at least some turbulence within the stock, such as formation showers. As the stock on the open surface forming fabric moves through the forming section, water is removed from the stock until an incipient paper web is formed which contains from about 75% to about 85% water. The remainder of the water is removed in subsequent parts of the papermaking machine.

The thickness of the stock layer deposited from the head box slice onto the forming fabric is determined by the machine speed, the water content of the stock delivered from the head box, and the basis weight of the paper or board product being manufactured. Heavier grade products, such as linerboard, corrugating medium, market pulp grades, and paperboard products, require a greater initial stock thickness than lighter grades, such as newsprint.

To provide an acceptable paper product, it is important that the paper making solids, including the paper making fibers, be thoroughly mixed and dispersed as randomly as possible in the stock leaving the headbox slice. In practice this is almost impossible to achieve: a proportion of the paper making fibers tend to flocculate in the stock and are deposited as flocs onto the forming fabric. Flocculation will continue in the stock on the forming fabric unless steps are taken to generate turbulence within the stock. Once an incipient paper web is formed it is essentially impossible to disperse any remaining flocs. Thus, what occurs in the stock on the forming fabric to convert it from a dilute solution of fibers and other solids into an incipient paper web is of vital importance to the papermaker.

Numerous methods have been proposed to randomize fiber distribution in the stock in the forming section. Most of these methods involve creating a level of turbulence within the stock to disperse flocs. For example, it is known to impart a rapid transverse vibrating motion to the forming fabric adjacent to the headbox, so as to apply a destructive shear force into the flocs and thereby redistribute the paper making fibers. Formation showers, table rolls, and various air and water jets, located either above or below the forming fabric, have also been used to create turbulence in the stock layer. The amount of energy required to impart a desirable level of turbulence into the stock is generally a function of stock layer thickness, machine speed, and the type of furnish present in the stock.

A common means of creating turbulence within the stock on an open surface moving forming fabric is to locate dewatering elements (such as foils, agitator blades and the like) in supporting contact with the machine side of the moving forming fabric. Devices of this type are described by Wrist, U.S. Pat. No. 2,928,456; Sepall, U.S. Pat. No. 3,573,159; Johnson, U.S. Pat. No. 3,874,998; Saad, U.S. Pat. No. 4,420,370; Kallmes, U.S. Pat. No. 4,687,549 and U.S. Pat. No. 4,838,996; and Fuchs, U.S. Pat. No. 4,789,433. Foils have a leading edge that skims liquid from the forming fabric; the trailing portion is declined downwards at an angle of from about 1° to about 8°, and serves to provide a suction effect which withdraws liquid from the stock and causes the fabric to deflect sufficiently to induce at least some turbulence within the stock.

Agitator blades are profiled so that some water is withdrawn and then redirected back through the forming fabric into the fluid stock layer. A carefully profiled cross-machine direction channel is located in the blade surface to achieve this; the water thereby redirected back through the forming fabric creates turbulence in the stock on the fabric, which provides a deflocculating effect and serves to randomize the solids distribution.

Another means of inducing agitation is disclosed by Johnson, U.S. Pat. No. 4,140,573. In this device, at least one of the dewatering elements on a low vacuum dewatering box are lowered a small amount relative to those on either side so that, as the fabric passes over the sequence of elements, it is pulled down a small amount by the dewatering box vacuum and then released, causing some turbulence within the stock.

An alternative means of inducing stock turbulence is described by Cabrera y Lopez Caram, U.S. Pat. No. 5,830,322. In this device a pair of fabric supporting elements are used, a primary element with a declining surface together with a trailing element with a horizontal surface. Drainage of water from the stock is controlled by restricting the size of a cross machine direction drainage gap between the two elements. The primary element declining surface is configured to impart turbulence into the stock above the drainage gap, without downwardly deflecting the forming fabric into the drainage gap, utilizing blade profiles substantially as described by Fuchs, U.S. Pat. No. 4,789,433 and by Kallmes, U.S. Pat. No. 4,838,996. The apparatus relies on fluid flow into and out of the drainage gap and on the shape of the declining surface of the primary element within the drainage gap, to cause turbulence within the stock after the fluid has been returned through both the forming fabric and any incipient paper mat formed thereon to the stock.

Other stock agitating devices are described by Cowan, U.S. Pat. No. 3,922,190; Marx, Jr., U.S. Pat. No. 4,999,086; Hansen et al., U.S. Pat. No. 5,011,577; Hansen, U.S. Pat. No. 5,089,090; and Neun, U.S. Pat. No. 5,681,430.

However, in situations where the paper product being made requires that the forming fabric moves at a relatively slow speed, and carries a relatively thick stock layer, for example in the production of heavy basis weight products, it becomes more difficult to generate the desired levels of turbulence within the stock. As machine speed decreases, and stock thickness increases, in the manufacture of heavy basis weight products, it becomes increasingly difficult to create an effective amount of turbulence within the stock, and hence to improve formation. It is thus found that for open surface forming sections in which the forming fabric is moving at speeds of less than about 400 m/min, carrying stock layers whose initial thickness is greater than about 2.0 cm at the head box slice, and producing heavier grade paper products with basis weights in excess of about 160 gsm, there is still a need for a device that is capable of generating an effective level of turbulence within the stock sufficient to cause at least some deflocculation within the stock. It would also be a considerable advantage if such a device could be readily adjustable so that the level of turbulence can be matched to the paper maker's requirements.

An additional problem occurs with stock compositions using a furnish having a high content of relatively short fibers or recycled materials. In these stocks, an almost impenetrable mat can be formed on the paper side of the forming fabric surface, effectively sealing the fabric and preventing adequate drainage of the stock; a phenomenon commonly referred to as "sheet sealing". A need therefore exists for a dewatering device capable of at least alleviating drainage restrictions arising from this phenomenon

SUMMARY OF THE INVENTION

The present invention seeks to provide an apparatus and a method for generating stock turbulence sufficient to cause at least some stock deflocculation, and to improve formation in an open surface paper making machine forming section in which the stock layer is relatively thick, and in which the forming fabric moves at a relatively low speed. This invention thus seeks to improve formation in open surface papermaking machines which are used to make relatively heavier basis weight products such as board stock and the like. This invention also seeks at least to alleviate, if not eliminate, sheet sealing by generating sufficient turbulence within the stock so as to redistribute the fibre mat forming a more or less impenetrable layer on the paper side of the forming fabric. This invention consequently is of particular relevance to the use of stock compositions containing a significant content of relatively short fibers, or of recycled materials.

Further, in one particular embodiment, this invention seeks to provide an adjustable apparatus for generating a controllable level of stock turbulence sufficient to cause at least some stock deflocculation, and to improve formation in an open surface paper making machine forming section in which the stock layer is relatively thick, and in which the forming fabric moves at a relatively low speed.

In the context of this invention, a "relatively low speed" refers to an open surface forming fabric that is moving through the forming section at a linear speed of less than about 400 m/min; a "relatively heavier basis weight product", and a "relatively thick stock layer", each refer to an open surface forming fabric machine that is being used to make a product with a finished basis weight over about 160 gsm, which will generally require a stock layer more than about 2.0 cm thick adjacent the headbox slice. It should also be noted that although this invention is concerned with the manufacture of products with a relatively high basis weight it is not so limited, and under some circumstances is of benefit with lighter products, and at higher machine speeds.

According to a first aspect of the present invention, there is provided an apparatus for generating turbulence in the stock on a forming fabric in an open surface forming section of a paper making machine, the forming section including a relatively slowly moving forming fabric having a paper side and a machine side, a relatively thick stock layer on the paper side thereof, a dewatering box means located beneath the forming fabric connected to a controlled vacuum supply means operable to create a reduced pressure within the dewatering box, and a plurality of forming fabric supporting dewatering elements carried by the dewatering box consisting essentially of:

(i) a lead-in dewatering element having a fabric supporting surface comprising in sequence:
- a doctoring leading edge;
- a substantially horizontal intermediate surface; and
- a declining trailing surface;

(ii) a riser dewatering element having a fabric supporting surface comprising in sequence
- a doctoring leading edge;
- an inclined surface;
- an exit surface; and
- a portion comprising the junction of the inclined and exit surfaces; and (iii) at least one intermediate dewatering element located between the lead-in dewatering element and the riser element and spaced from each other dewatering element by a gap, the or each intermediate element having a fabric supporting surface comprising in sequence:
- a doctoring leading edge;
- a declining surface; and
- a trailing edge;

wherein:

(a) the portion of the riser element located at the junction of the inclined and exit surfaces is chosen from an apex at the junction of the inclined surface and the exit surface, a short substantially horizontal surface linking the inclined surface and the exit surface, and a curved surface linking the inclined surface and the exit surface;

(b) the intermediate surface of the lead-in dewatering element, and the portion of the riser element comprising the junction of the inclined and exit surfaces define a first plane;

(c) the declining trailing surface of the lead-in dewatering element and the declining surface of the or each intermediate dewatering element(s) define a second plane inclined at a pre-selected downward trailing angle with respect to the first plane; and (d) the doctoring leading edge of the riser element is located above the trailing edge of the adjacent intermediate dewatering element, such that movement of the forming fabric from the trailing edge of the adjacent intermediate dewatering element to the doctoring leading edge of the riser element results in a vertical movement of the forming fabric, and of the incipient paper web and the stock carried thereon.

Preferably, the at least one intermediate dewatering element located between the lead-in dewatering element and the riser element and spaced from each other dewatering element by a gap, is adjustably attached to the dewatering box permitting location of the or each declining surface thereof in the desired second plane, and permitting movement to a different desired second plane. In this embodiment, as is set forth in more detail below, the included angle between the first and second planes instead of being determined by the angle to which the intermediate element declining surface is cut, is determined by the setting of the adjustable attachment to the dewatering box. In this embodiment, since the lead-in element is not adjustably mounted, it is preferred that its declining trailing surface is arcuate.

In an alternative preferred embodiment, the apparatus further includes a drainage restricting element, which is interposed between the riser element and the adjacent intermediate element, having a fabric supporting surface comprising in sequence:

a doctoring leading edge; and an upwardly inclined surface;

wherein the attachment of the drainage restricting element to the dewatering box is constructed and arranged to locate the upwardly inclined surface at an angle to the second plane so as to provide a shallow "V" angle therebetween conforming to the inclined surface of the riser element. In this embodiment, the attachment of the drainage restricting element to the dewatering box can be chosen from the group consisting of a fixed attachment, an adjustable attachment, and a second adjustable attachment incorporated into a first adjustable attachment for the intermediate elements.

Preferably, all of the intermediate fabric supporting elements are of the same width in the machine direction. Alternatively, all of the intermediate fabric supporting elements are not of the same width in the machine direction.

Preferably, the or each intermediate fabric supporting element has a substantially flat declining surface. Alternatively, at least one intermediate element has an agitator blade profile.

In an alternative aspect, this invention seeks to provide a method for creating a desired level of turbulence in a stock layer carried on a forming fabric in an open surface forming section of a papermaking machine, consisting essentially of moving the forming fabric carrying the stock over at least one dewatering box means carrying a plurality of fabric supporting elements beneath, and in supportive contact with, the forming fabric, and applying a controlled vacuum supply to create a controlled reduced pressure in the dewatering box, the dewatering fabric supporting elements consisting essentially of:

(i) a lead-in dewatering element having a fabric supporting surface comprising in sequence:
a doctoring leading edge;
a substantially horizontal intermediate surface; and
a declining trailing surface;

(ii) a riser dewatering element having a fabric supporting surface comprising in sequence
a doctoring leading edge;
an inclined surface;
a exit surface; and
a portion comprising the junction of the inclined and exit surfaces; and (iii) at least one intermediate dewatering element located between the lead-in dewatering element and the riser element and spaced from each other dewatering element by a gap, the or each intermediate element having a fabric supporting surface comprising in sequence:
a doctoring leading edge;
a declining surface; and
a trailing edge;
wherein:
(a) the portion of the riser element located at the junction of the inclined and exit surfaces is chosen from an apex at the junction of the inclined surface and the exit surface, a short substantially horizontal surface linking the inclined surface and the exit surface, and a curved surface linking the inclined surface and the exit surface;
(b) the intermediate surface of the lead-in dewatering element, and the portion of the riser element comprising the junction of the inclined and exit surfaces define a first plane;
(c) the declining trailing surface of the lead-in dewatering element and the declining surface of the or each intermediate dewatering element(s) define a second plane inclined at a pre-selected downward trailing angle with respect to the first plane; and
(d) the doctoring leading edge of the riser element is located above the trailing edge of the adjacent intermediate dewatering element, such that movement of the forming fabric from the trailing edge of the adjacent intermediate dewatering element to the doctoring leading edge of the riser element results in a vertical movement of the forming fabric, and of the incipient paper web and stock carried thereon.

Preferably, the desired level of turbulence is created and controlled by at least one adjustable intermediate dewatering element located between the lead-in dewatering element and the riser element which is adjustably attached to the dewatering box permitting location of the or each declining surface thereof in the second plane; and the level of turbulence is controlled by adjusting the adjustable intermediate supporting element to a desired second plane location.

More preferably, the desired level of turbulence is created by an apparatus further including a drainage restricting element, which is interposed between the riser element and the adjacent intermediate element, having a fabric supporting surface comprising in sequence:

a doctoring leading edge; and an upwardly inclined surface;

wherein the attachment of the drainage restricting element to the dewatering box is constructed and arranged to locate the upwardly inclined surface at an angle to the second plane so as to provide a shallow "V" angle therebetween in conformance with the inclined surface of the riser element.

Most preferably, the desired level of turbulence is created and controlled by:

(i) at least one adjustable intermediate dewatering element located between the lead-in dewatering element and the riser element which is adjustably attached to the dewatering box permitting location of the or each declining surface thereof in the second plane; and (ii) a drainage restricting element, which is interposed between the riser element and the adjacent intermediate element, having a fabric supporting surface comprising in sequence:
a doctoring leading edge; and
an adjustable upwardly inclined surface;
wherein the level of turbulence is controlled by:
(a) adjusting the adjustable intermediate supporting element to a desired second plane location; or
(b) adjusting the drainage restricting element to a different location; or
(c) adjusting both the adjustable intermediate supporting element to a desired second plane location, and adjusting the drainage restricting element to a different location.

Preferably, the angle between the first and second planes is from greater than 0° to about 10°.

One advantage that has been found with the apparatus of this invention is that with relatively thick stock layers once a desired level of turbulence has been induced in the stock, it is less difficult to maintain a desired level of turbulence further along the forming section. Hence, although the known devices are not always capable generating an acceptable level of turbulence, they are sufficient to maintain that level of turbulence once it has been generated. The present invention thus can be used to optimize the performance of these prior art devices.

As a consequence of this, the shape of the exit surface on the riser blade will be determined by what follows the dewatering device of this invention in the forming section. For example, if it is immediately followed by a second set of the same elements so that the riser element is both the last element on one set, and the first element in the next set, the exit surface of the riser blade will be the same shape as that of the corresponding part of a lead-in element, so that it will have a substantially horizontal intermediate surface, and a declining trailing surface in the same second plane as the following elements. Alternatively, if it is followed by an undrained gap, or by a drainage box equipped with foils, the exit surface of the riser blade will be generally shaped as a foil blade, with a foiling angle generally of from about 0.5° to about 5°.

BRIEF DESCRIPTION OF THE DRAWINGS

The present invention will now be described with reference to the attached Figures, wherein.

DETAILED DESCRIPTION

In the context of this invention, the following directional terms have the meanings given:

"machine direction" means a direction along the machine substantially parallel with the direction of travel of the forming fabric;

"cross machine direction" means a direction substantially perpendicular to the machine direction generally parallel to the plane of the forming fabric;

"upstream" refers to a direction closer to the headbox from a given point in the machine direction;

"downstream" refers to a direction further from the headbox in the machine direction:

"leading" refers to an upstream element edge;

"trailing" refers to a downstream element surface or edge;

"paper side" refers to the face of the forming fabric upon which the stock is deposited, and the paper web is formed; and "machine side" refers to the side of the forming fabric in contact with the fabric supporting elements, and thus is the other side from the paper side.

In all of the schematic dewatering box cross sections shown in the Figures, the fabric supporting elements all extend in the cross machine direction for the full width of the forming fabric. Additionally, all of the angles shown have been enlarged for clarity.

Figure 1:
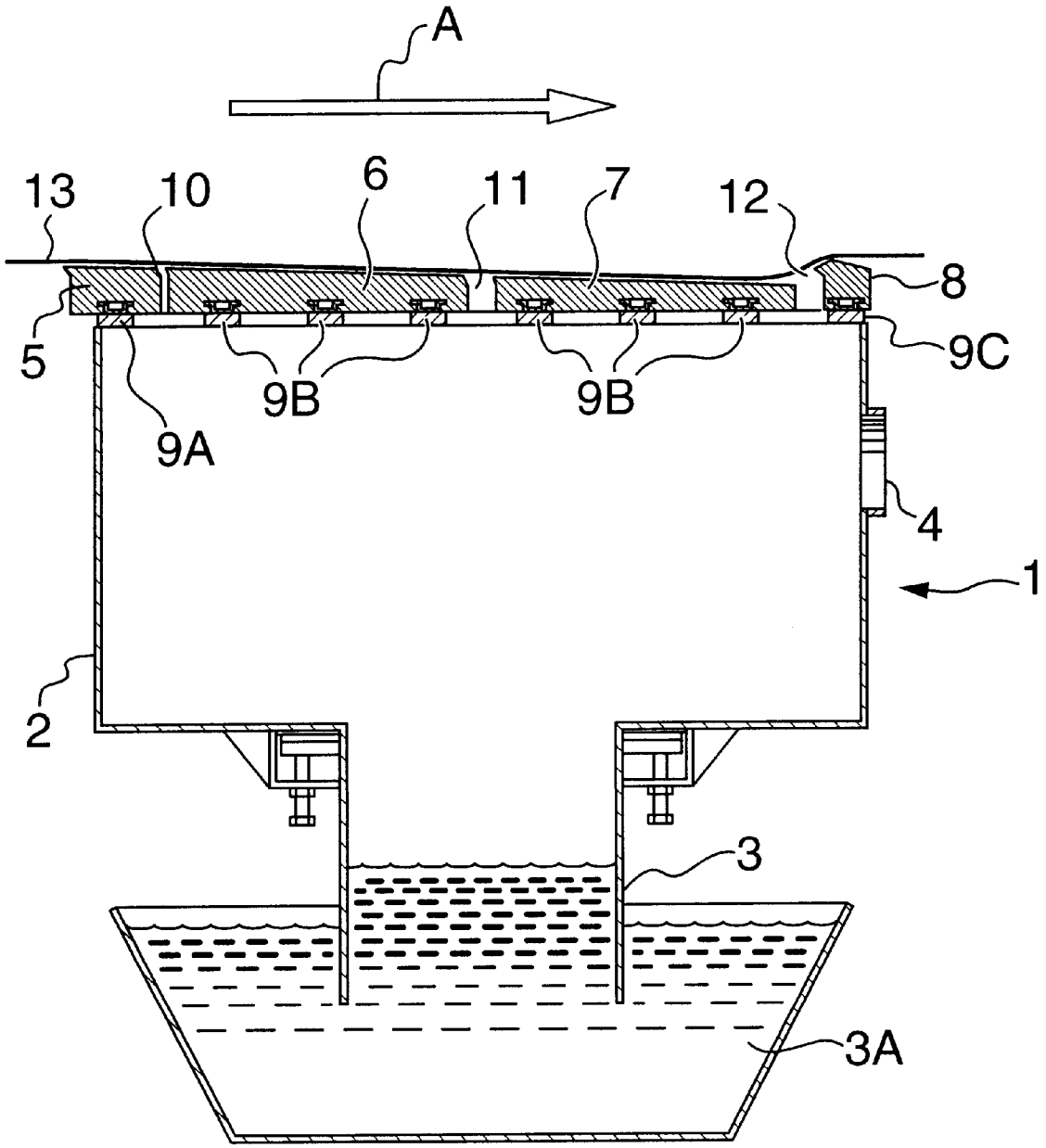
FIG. 1 shows schematically a cross section in the machine direction of a stock turbulence generating unit in accordance with a first embodiment of the present invention.

In FIG. 1 is shown a first embodiment of this invention. In both this Figure and later Figures most of the other conventional parts of a forming section, such as the headbox, headbox slice, breast roll, a forming board (if present), a forming shower or showers, and any other drainage or formation devices are not shown. The stock turbulence generating device 1 includes a dewatering box 2, which is provided with a hydraulically sealed drain 3 at the bottom, through which the water 3A drained from the stock escapes. Dewatering box 2 is attached by the pipe 4 to a vacuum source which provides a controlled reduced pressure in the range of from ambient pressure to about 7.5 kPa below ambient pressure.

A desired level of turbulence is generated in the stock by the set of fabric supporting elements 5, 6, 7 and 8, which are mounted onto the top rail of the dewatering box 2 using a conventional T-bar arrangement, as at 9A, 9B and 9C. In combination, the spacing of the T-bars and the widths of the elements determines the widths of the drainage gaps 10, 11, and 12. These gaps are sealed at their lateral edges with end deckles (not shown). In the illustrated embodiment, gaps 10 and 11 are the same width and gap 12 is wider. The factors influencing the choice of gap widths is discussed below. The elements 5, 6, 7 and 8 can be formed from high density polyethylene, with inserted ceramic wear surfaces, or any other material appropriate for forming fabric support surfaces. Within the set of fabric supporting elements shown, element 5 is the lead-in blade, element 8 is the riser blade, and elements 6 and 7 are the intermediate blades.

The forming fabric 13 moves in the direction of the arrow A with its machine side in contact with the supporting elements 5–8. Over the gap 12, the forming fabric 13 rises from the last intermediate element 7 onto the riser element 8. This vertical movement of the forming fabric, and of the incipient paper web and stock carried by it, induces turbulence within the stock adjacent to, and downstream of, the exit surface of the riser element 8.

Figure 2:
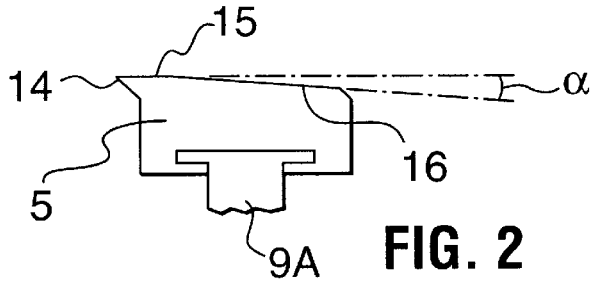
FIGS. 2, 3 and 4 show cross sections of the fabric supporting elements used in FIG. 1.

The cross section of the lead-in element 5 is shown in FIG. 2. This includes a doctoring leading edge 14, a flat intermediate surface 15, and a declining trailing surface 16. In this embodiment, the trailing surface is substantially flat, and is at an angle of inclination $\alpha$, relative to the surface 15. The element is mounted onto the T-bar 9A so that the surface 15 is substantially horizontal. The doctoring leading edge 14 removes at least some of water that has drained through the forming fabric upstream of the lead-in element.

Figure 3:
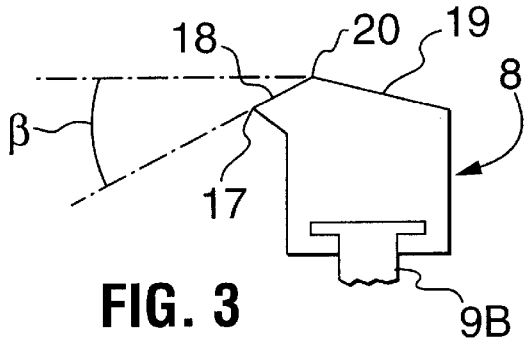

The cross section of the riser element 8 is shown in FIG. 3. This includes a doctoring leading edge 17, an inclined surface 18, an exit surface 19, and a portion 20 comprising the junction between the inclined and exit surfaces. As shown, the portion 20 is the apex at the junction of the two surfaces 18, 19 on either side; alternative shapes are a short horizontal surface, and a curved surface. The underlying requirement for the portion 20 of the riser element is that it provide a continuum of support for the forming fabric moving and bending over it, and that together with the substantially horizontal surface 15 of the lead-in element it defines the first plane, below which the fabric is deflected during its passage over the intermediate elements. The exact shape of the portion 20 is chosen based on the constructional materials used, and the desired lengths of the inclined surface 18 and the exit surface 19. The inclined surface 18 is at an angle β, which is measured between the inclined surface and the first plane defined by the surface 15 on the lead-in element, and the portion 20 of the riser element. The shape of the exit surface 19 is discussed below.

Figure 4:
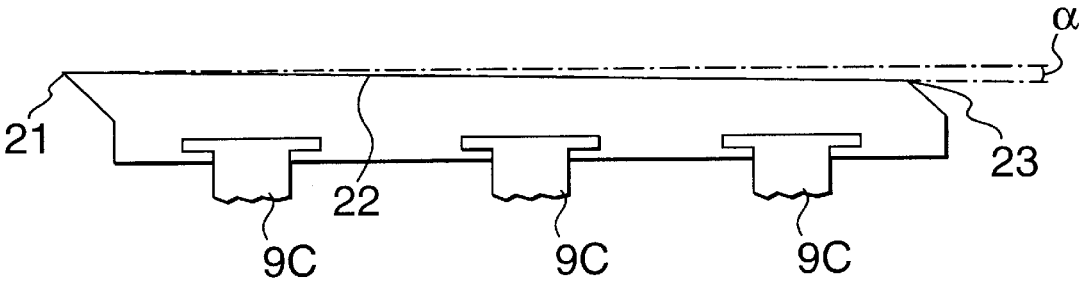

In FIG. 1, two intermediate elements 6 and 7 are shown, which are generally the same. The cross sections of these are generally the same, and that of intermediate element 6 is shown in FIG. 4. This includes a doctoring leading edge 21, a declining surface 22, and a trailing edge 23. The set of three elements comprising the lead-in element and the two intermediate elements supported by the T-bars 9C are spaced apart so that the surface 16 and the two surfaces 22 are in a common second plane at the angle α relative to the first plane.

In the apparatus of this embodiment of this invention, as shown in FIG. 1, as fabric 13 moves over the dewatering box 2, the machine side of fabric 13 first engages leading edge 14 of lead-in element 5 which skims liquid from the machine side of fabric 13. The forming fabric 13 continues downstream and passes over, in succession, inclined surface 16, gap 10, inclined surface 22 and trailing edge 23 of intermediate element 6, gap 11, inclined surface 22 and trailing edge 23 of intermediate element 7, gap 12, and finally leading edge 17, and surfaces 18, 20, and 19(in that order) of riser element 8. The fabric is pulled down onto the surface 16 and the two surfaces 22 in sequence by the controlled low vacuum in the dewatering box so as to form a fluid seal on these surfaces. Finally, the forming fabric rises upwardly over the gap 12 and the surfaces of the riser element 8. This upward movement generates turbulence in the stock in the vicinity of the riser element 8.

In this embodiment, the value chosen for the angle α is determined by the machine characteristics, which includes the overall separation of the lead-in and riser elements, the number of intervening intermediate elements, the machine speed, the thickness of the stock layer, and the level of turbulence desired in the product being made. Consequently, the value of α determines the vertical distance through which the forming fabric must rise from the locus where it loses contact with the last intermediate element, which is at or near to the trailing edge 23 of this element, to the doctoring leading edge 17 of the riser element. Generally, α is in the range of from about 0.25° to about 10°. For most purposes it has been found that α is less than 6° and often is in the range of from about 2° to about 4°. The gap widths between each of the elements making up the set, in combination with the applied vacuum, and the properties of the stock and of the furnish in the stock also affect both the amount of drainage that occurs, and the amount of turbulence that is generated. The level of applied vacuum in combination with the gap widths must be sufficient to ensure that the forming fabric is in hydraulic contact with the fabric supporting surfaces of all of the elements. The actual value of the applied vacuum also influences the level of turbulence, since it influences the transition of the forming fabric from the last intermediate element onto the riser element. At this point, the forming fabric has a shallow "V" shape, which is sharper or flatter depending at least in part on the vacuum applied. The actual values chosen for α, and of the other identified variables, will be determined by the amount of turbulence that is desired in the stock at that point in the forming section; some experimentation may be required to determine optimum values for a given set of paper making conditions.

The shape of the exit surface 19 of the riser element 8 depends to a large extent on what follows this element downstream in the forming section, for which there are several choices. The riser element may be followed, for example, by another identical stock turbulence generating unit, an uncontrolled drainage gap, by a set of foils, or by an Isoflo(trade mark) drainage unit. When the next drainage unit is another more or less identical unit contiguous with, or even mounted on the same drainage box as the preceding unit, the riser element becomes common to both units. The exit surface of the riser element is then profiled as if it is a lead-in element, so that it matches the chosen value of α for the following unit, which may not be the same as that of the preceding unit. When the riser element is followed by a gap, or a foil unit, it appears to be sufficient to use an exit surface that is either substantially horizontal, or is downwardly inclined at more or less the same angle as is used for a conventional foil blade, that is up to about 5°, without an intervening short horizontal surface.

The inclined surface of a riser element, as at 18 in FIG. 3, is generally at a fairly steep rising angle, as it defines the path of the rising forming fabric as shown in FIG. 1. The angle β shown in FIG. 3 will generally be in the range of from about 0° to about 30°. In practice, an angle of from about 10° to about 20° is often sufficient. The value of the angle β is determined by the vertical displacement of the forming fabric as it rises from the declining surface 22 of the last intermediate element to the surface 20 of the riser element. The value of β should be selected to minimize fabric deflection with a low vacuum level. If in operation the fabric deflection is, or becomes greater than this, it is found that the forming fabric still engages with and follows the shape of this surface. However, some experimentation may be necessary to determine the optimum value of β for a given set of machine conditions.

Further, it appears that once a desired level of turbulence has been created in the stock by the apparatus of this invention it is easier to induce turbulence in the stock downstream in the forming section, thus facilitating the use downstream of subsequent turbulence generating devices. This enhances the operation of subsequent conventional deflocculation and dewatering devices and improves the formation in the product being produced. In a similar fashion, it is observed that the apparatus of this invention will enhance a lower level of turbulence created in the stock by an upstream device, such as a formation shower.

While the embodiment described above is applicable when the fabric speed is 400 m/min or less and the stock relatively thick, for example 2.0 cm or more adjacent the head box slice, for manufacturing paper products whose basis weights is 160 gsm or greater, it is contemplated that the present invention will also provide advantages in other circumstances, such as higher fabric speeds and/or thinner stock layers.

Unexpectedly, it has been discovered that, once fabric 13 is running at machine speed over the dewatering box 1 under an applied vacuum, it will often continue to follow the path defined by the supporting elements 5, 6, 7 and 8 even if the vacuum is reduced. This permits a reduction in the amount of drainage over the dewatering box 2. This provides an additional benefit in reducing any tendency for sheet sealing.

Figure 5:
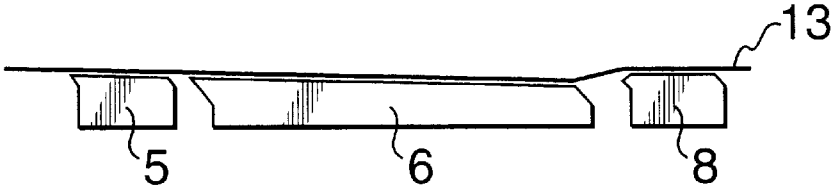
FIGS. 5 and 6 show alternative element arrangements to that shown in FIG. 1.
Figure 6:
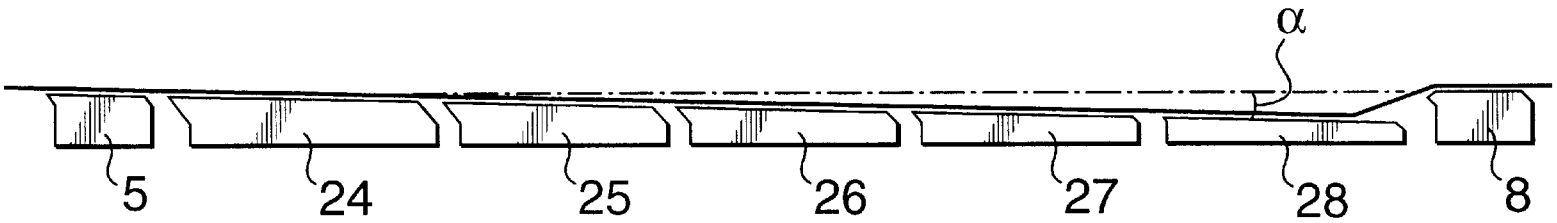

In the embodiment shown in FIG. 1, the unit shown has two intermediate dewatering elements 6 and 7. Depending on the machine characteristics and the product being made, other configurations can be used. FIG. 5 shows one intermediate dewatering element 6 between a lead-in element 5 and a riser element 8 and FIG. 6 shows a configuration using five intermediate elements 24, 25, 26, 27 and 28, in which all five intermediate elements are arranged to be in the second plane at a common angle $\alpha$ to the first plane. It is also shown in FIG. 6 that the intermediate elements need not all be the same width.

Figure 7:
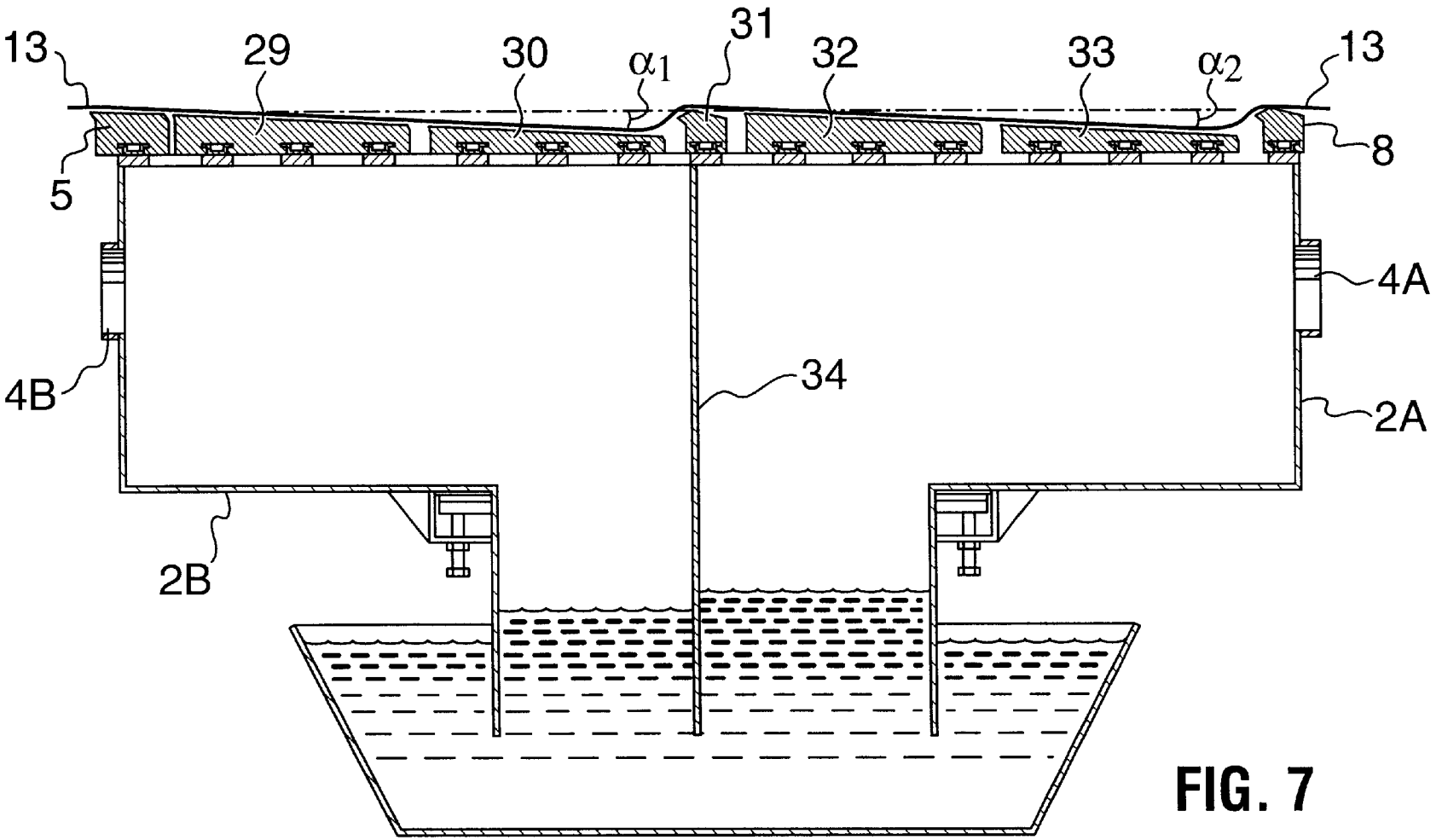
FIG. 7 shows schematically a cross section in the machine direction of a stock turbulence generating unit incorporating two sets of fabric supporting elements.

It is also possible to utilize this invention with two dewatering units in sequence, with the riser element of the first unit also serving as the lead-in element of the second one. This arrangement is shown in FIG. 7. The first set of elements includes a lead-in element 5, and two intermediate elements 29 and 30. The second set of elements includes again two intermediate elements 32 and 33, and a riser element 8. The central element 31 functions as riser for the first set, and lead-in element for the second set. Its upstream inclines surface 18 is shaped to conform to a riser element, and its downstream declining trailing surface is shaped to conform to a lead-in element. This arrangement also can be set up in two different ways:

(i) a single dewatering box 2 can be used, with a single vacuum supply 4, as shown essentially in FIG. 1; or (ii) a dewatering box with two hydraulically separate compartments 2A and 2B, separated by wall 34, each of which have their own vacuum supplies 4A and 4B, as shown in FIG. 7.

In this latter arrangement, the vacuum applied to the two compartments need not be the same. It is also possible that the angles $\alpha_1$ and $\alpha_2$, both of which are measured relative to the first plane as shown in FIG. 7, need not be the same, depending on the level of turbulence desired in each unit.

Figure 8:
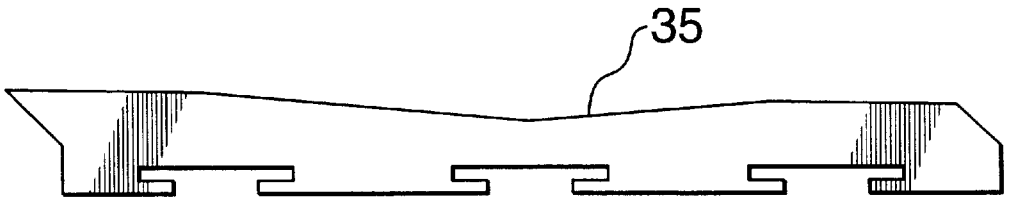
FIG. 8 shows schematically an intermediate element including an agitator blade profile.

In the embodiments shown, the intermediate elements have an essentially planar forming fabric supporting surface. In certain circumstances, depending on both the machine characteristics, the stock characteristics, and the product being made, it has been found desirable to cause more turbulence in the stock than is caused by utilizing planar forming fabric supporting surfaces on the intermediate elements in the second plane. As is shown in FIG. 8 an intermediate element with a so-called agitator blade profile with a single channel 35 can be used to induce additional turbulence. Agitator blades having this surface profile are described, for example, by Johnson in U.S. Pat. No. 3,874,998; other profiles are known and used. It appears that an agitator blade profile can enhance the turbulence effects provided by the turbulence generating unit of this invention.

In a similar fashion, it is also contemplated within this invention for the dewatering device to share a common dewatering box with a different dewatering device, such as an Isoflo(trade mark), agitator blades, or a set of foil blades.

EXPERIMENTAL TRIAL

In an experimental trial a stock turbulence generating unit according to the present invention was located downstream of a formation shower in an open surface forming section of a paper machine. The unit used was that shown in FIG. 7, but without the internal dividing wall 34, and only a single vacuum supply. Two suction boxes provided with covers substantially as described by Johnson in U.S. Pat. No. 4,140,573 were located immediately downstream of the unit. The machine speed of the forming section was approximately 320 m/min, and the paper board product had a basis weight of approximately 299 gsm. The lead-in element was 38.1 mm wide, with a declining surface 8.5 mm wide. The two intermediate elements were the same in each pair, and had a declining surface width of 150.9 mm The drainage gap between each of the elements was 9.5 mm, except for the gap downstream of each of the last intermediate elements, which was 12.7 mm. In both sets of elements, the value of $\alpha$ was 2°. The dewatering element acting as a common lead-in and riser element at the middle of the set had an inclined surface 9.5 mm wide, and the value of the angle $\beta$ was 5°. The downstream exit surface of this common element was substantially flat, and inclined downwardly at 2°, thus matching the value of $\alpha$. The exit surface of the second riser blade was horizontal. All of the element widths and the element separation gaps are measured in the machine direction.

During the trial, the vacuum level applied by the suction box was varied from ambient pressure to about 5 kPa below ambient pressure. It was found that when the formation shower located upstream was turned off, the visual appearance of the stock as it passed over the turbulence generating unit did not indicate any increased activity within the stock. however, it was found that both the drainage of the incipient sheet and quality of the resulting paper product, as evidenced by its formation and smoothness, improved as compared to its quality before the unit was installed. This indicated that the unit was effective in generating turbulence within the stock, and in preventing sheet sealing, despite the fact that the formation shower had been turned off.

When the formation shower was turned on, the visual appearance of the stock as it passed over the stock turbulence generating unit changed dramatically, indicating an increased level of stock activity. This shows that the stock turbulence generating unit of this invention is effective both in imparting turbulence into the stock so as to improve formation and prevent sheet sealing, and can enhance the performance of other drainage and turbulence generating devices.

In the embodiment described above, the location of the intermediate elements is determined by fixed structures, and the cross sectional profile of the intermediate elements determines the value of $\alpha$. Since the value of $\alpha$ is never very large, this construction requires precision machining and installation of the intermediate elements in order to provide a set of surfaces accurately located in the second plane.

In a second embodiment of this invention, instead of mounting each intermediate element directly onto the structure of the dewatering box, each intermediate element is adjustably mounted onto the structure of the dewatering box. It is then feasible to control the value of $\alpha$ by moving the whole intermediate element to provide an appropriate declining angle for the declining surface by adjusting the adjustable mounting, instead of constructing the element to provide the required fixed declining angle. In this configuration, where more than one intermediate element is used, it is preferred that all of the intermediate elements are mounted onto a single adjustable mounting at the desired machine direction separation with their forming fabric supporting surfaces in a common plane. The desired value of $\alpha$ is then obtained by adjusting the mounting, or mountings, as required.

In addition to greatly simplifying the construction of the turbulence generating unit, as all of the intermediate elements can be fabricated to essentially the same dimensions, this configuration has the added advantage that the value of α can be readily changed so as to alter the level of generated turbulence. This can be required for several reasons, such as a change in product, a change in furnish for the same product, and less than perfect mixing in the headbox causing problems on the forming fabric. Thus in addition to providing a means to generate turbulence within the stock on the forming fabric, this embodiment of this invention additionally provides a means whereby the level of turbulence created can be controlled, and either enhanced or diminished as paper making conditions require.

This embodiment of this invention is shown in FIGS. 9–13. In the FIGS. 9–12 the forming fabric is omitted for clarity.

Figure 9:
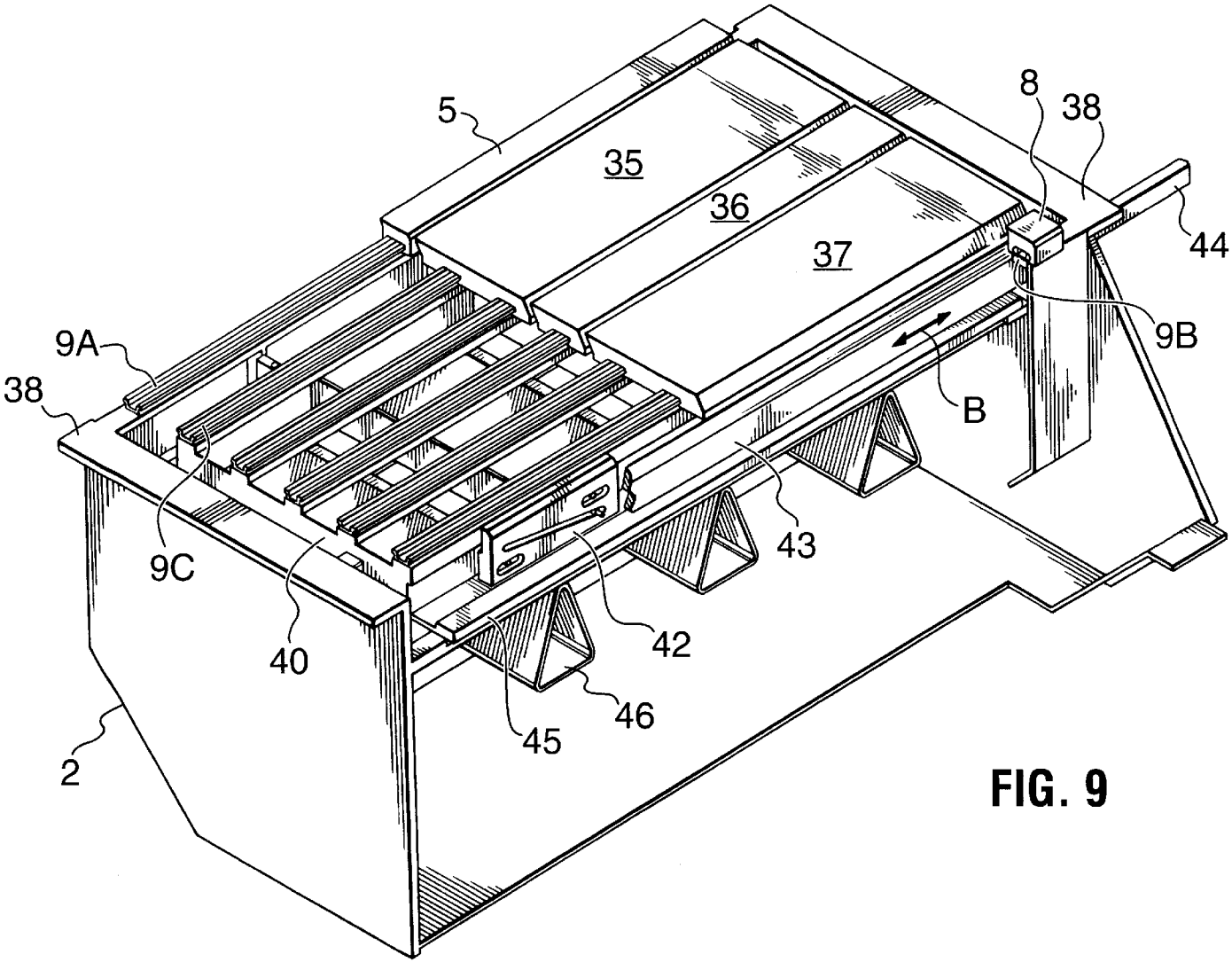
FIGS. 9 and 10 show schematically partially sectioned a stock turbulence generating unit in accordance with a second embodiment of the present invention.
Figure 10:
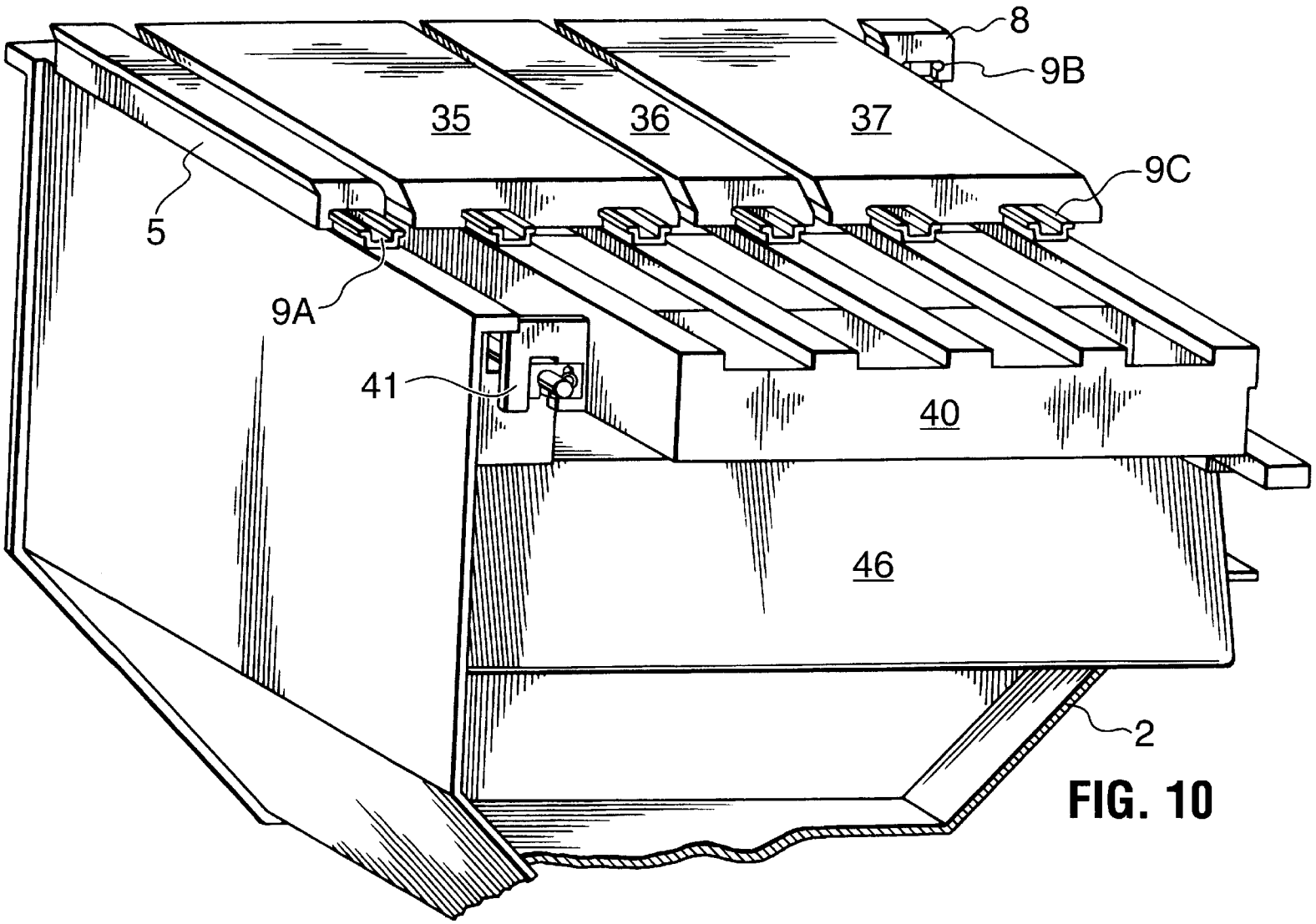

Referring first to FIGS. 9 and 10, which show partially cut away three quarter views of the unit, the unit includes a single dewatering box 2 supporting a lead-in element 5, three intermediate elements 35, 36 and 37 of which the middle one 36 is narrower than the other two, and a riser element 8. The lead-in element 5 and the riser element 8 are supported by T-bar structures 9A and 9B, both of which are directly supported by the frame 38 on the top of the dewatering box 2. The three intermediate elements are supported by similar T-bar structures 9C, each of which is mounted onto an adjustable supporting frame 40. At its upstream end, adjacent the lead-in element 5, the adjustable frame 40 is supported by a pivot assembly 41. At its downstream end, the adjustable frame 40 is provided with a vertical adjustment assembly 42, which in its turn is controlled by the adjustment bar 43 which is moved in the directions shown by arrow B by means of the handle 44. The adjustment bar 43 is supported by suitable bearing surfaces (not shown) on the beam 45 carried by the supporting framework of the dewatering box top shown generally as 46.

Figure 11:
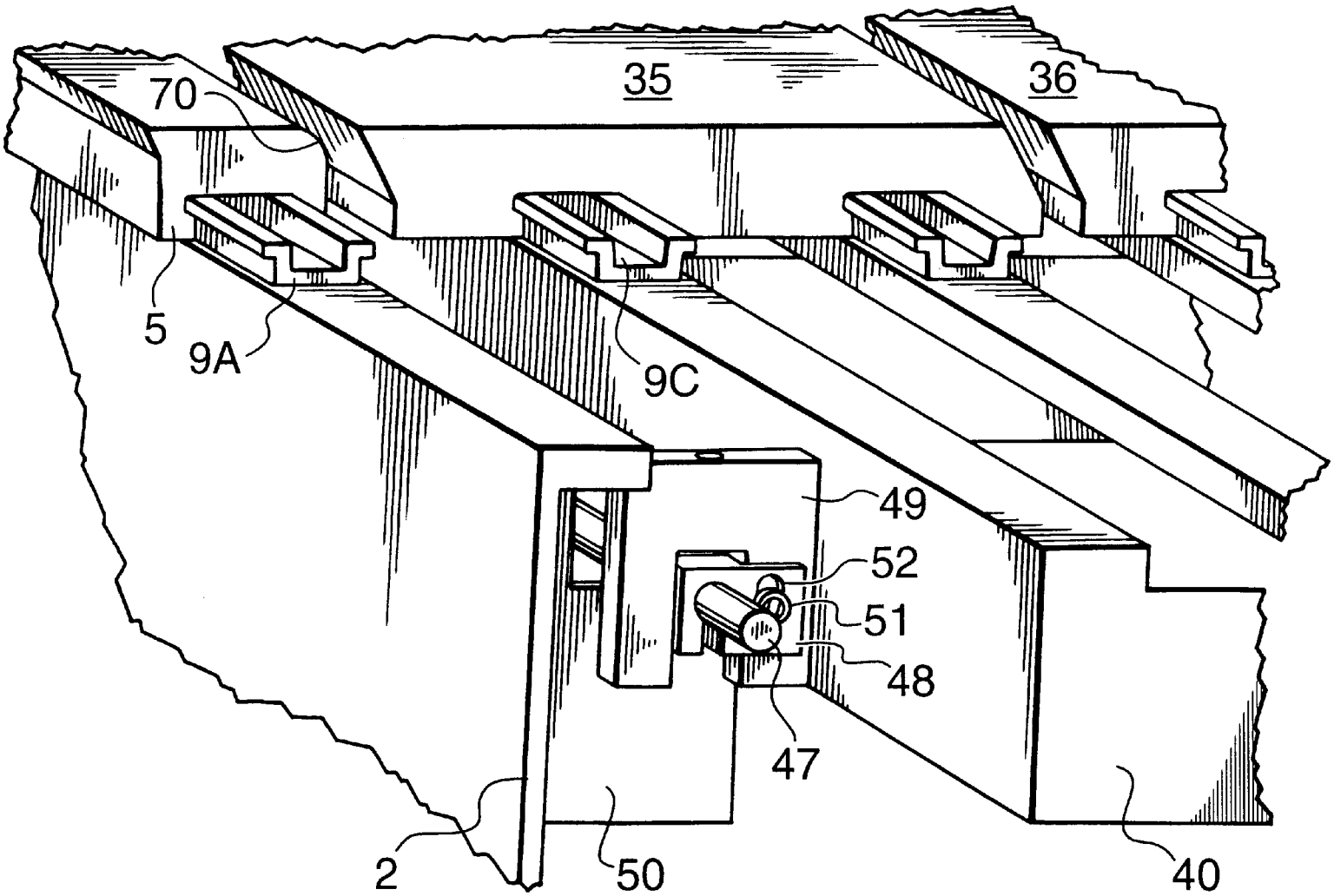
FIGS. 11 and 12 show details of the pivot and adjustment device used in FIGS. 10 and 11.

The upstream pivot is shown in more detail in FIG. 11. The frame 40 pivots through a small arc (which provides sufficient angular movement to obtain any desirable value for α) about rod 47 which is supported by the wall of the dewatering box 2, as at 50. The frame 40 is attached to the rod 47 by means of an adjustable bearer block 48 carried by a bracket 49. The bearer block is held in place by the lockbolt 51 which passes through the slot 52. This form of attachment allows fine control of the location of the surface of element 35 relative to the declining surface of the lead-in element 5. FIG. 11 shows only one pivot assembly; in practice there will be at least two, and often more, so that the upstream end of frame 40 is adequately supported for the full width of the forming section.

Figure 12:
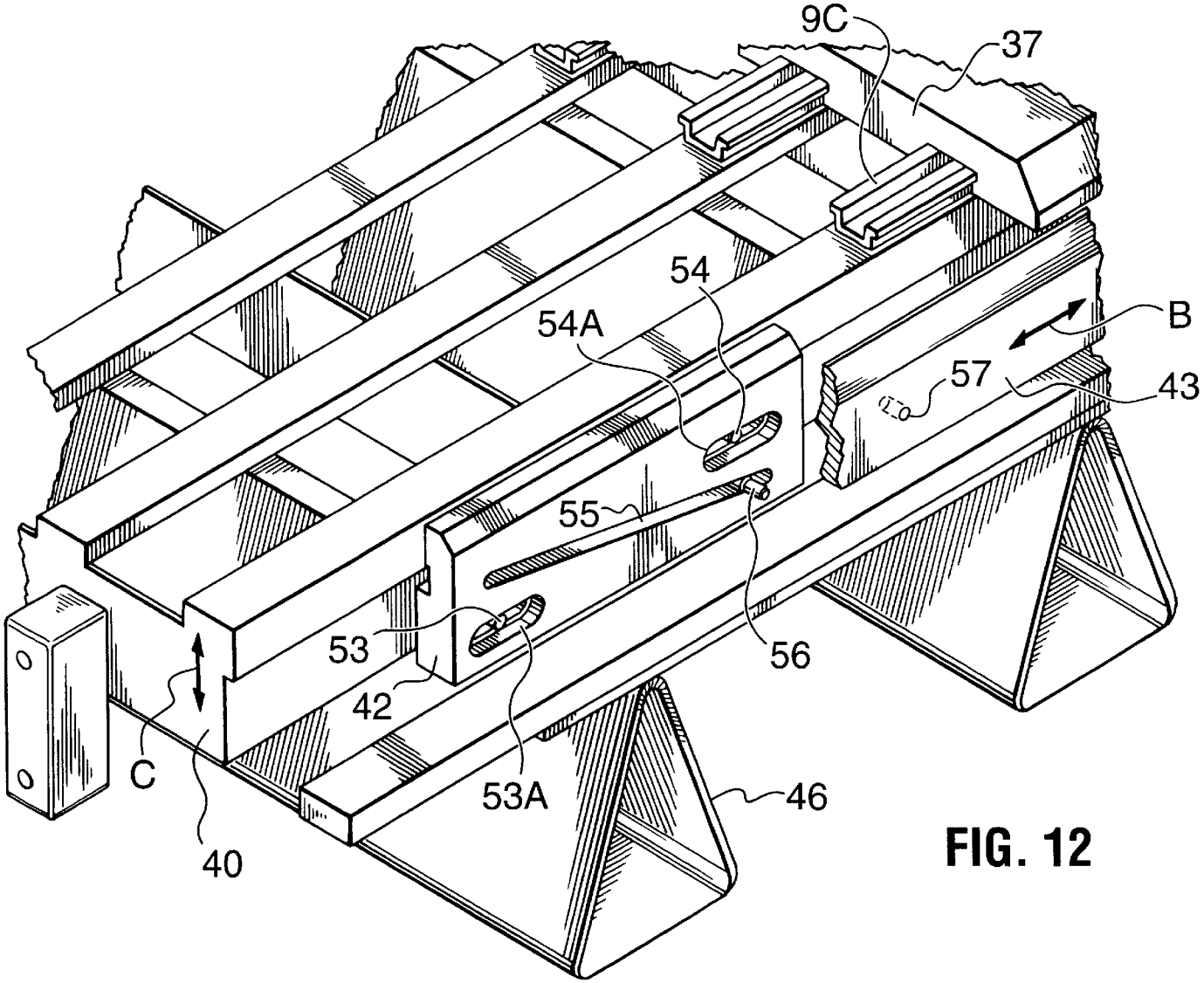

The downstream vertical adjustment assembly is shown in more detail in FIG. 12. The vertical adjustment assembly 42 is attached to the downstream face of the frame 40 by the bolts 53 and 54 which are provided with enlarged holes 53A and 54A. The assembly 42 also includes an angled slot 55, into which is fitted a captive pin 56. The outer end of the pin 56 engages into the aperture 57 in the adjustment bar 43. As a result, horizontal movement of the bar 43 in the directions of arrow B causes vertical movement of the frame 40 in the directions of arrow C. The enlarged holes 53A, 54A are provided to permit fine adjustment of the assembly 42 relative to the frame 40 so that the same value of α is obtained across the full width of the forming section. If desired, the bar 43 can be locked in a particular setting by using any appropriate locking mechanism. FIG. 12 shows only one adjustment assembly; in practice there will be at least two, and often more, so that the downstream end of frame 40 is adequately supported for the full width of the forming section.

It is also contemplated that other vertical adjustment means are useable: for example, the adjustment bar 43 can be replaced by a screw thread system, which can be motorized, and the whole adjustment means can be replaced by a hydraulic or pneumatic system. If the vertical adjustment means is to be freely operable, the fact that it is placed in an environment where it can be clogged with solids from the stock should be borne in mind.

Figure 13:
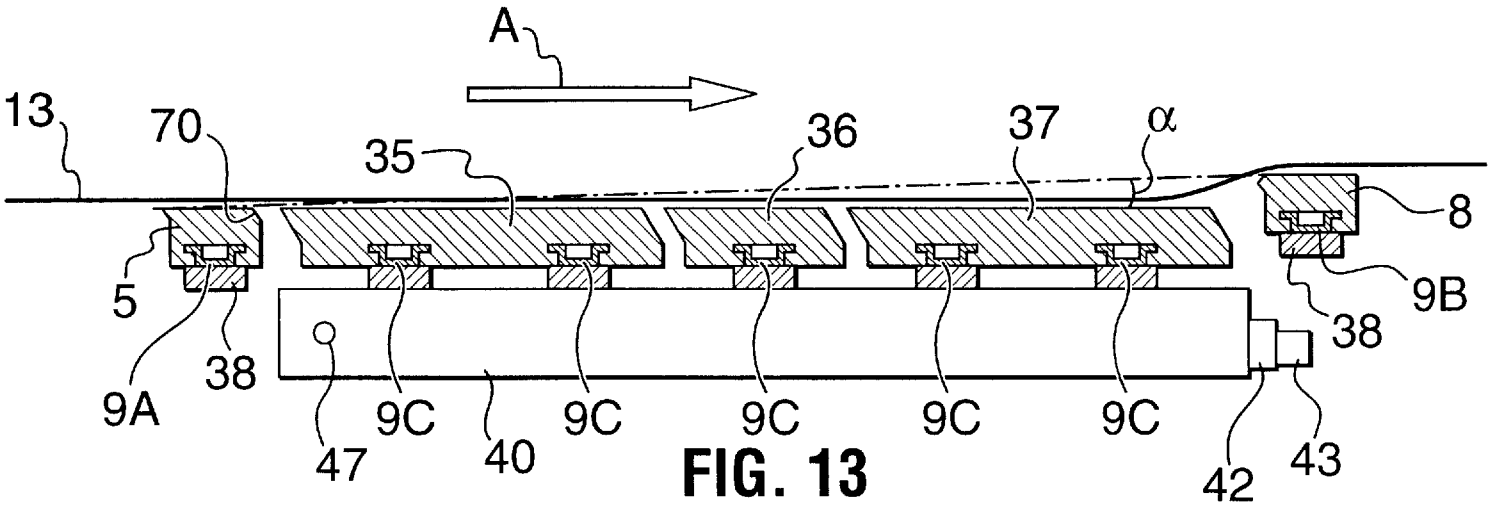
FIG. 13 shows schematically a cross section of the unit of FIGS. 9–12.

The cross section of the unit of FIGS. 9–12 is shown schematically in FIG. 13. The lead-in and riser elements 5 and 8 are supported by their T-bars 9A and 9B attached directly to the dewatering box 2. The three intermediate elements 35, 36 and 37 are each supported by T-bars 9C carried on the subframe 40. The subframe 40 is supported at its upstream end by the rod 47, about which it rotates to provide the required value for α. It is supported at its downstream end by the adjustment assembly 42 controlled by the adjusting bar 43. The actual value for α is determined by the position of the adjustment bar 43 relative to the vertical adjustment assembly 42.

In this arrangement, although the intermediate elements are adjustable to any desired value for α, the lead-in element is still fixed, and is unadjustable, so that its declining trailing surface is at a constant angle. In some circumstances, it has been found that this can result in the forming fabric deflection over the trailing edge of the lead-in element, which is not desirable for several reasons. It is therefore preferred that in this arrangement, as indicated at 70(see also FIG. 10), the lead-in element has an arcuate trailing edge.

It can thus be seen that in this preferred embodiment, rather than adjust each intermediate element individually to obtain the desired value of α, which requires either precise machining and installation, or precise individual vertical and angular adjustment, the set of intermediate elements are made all the same, and are mounted onto the subframe so that all of their forming fabric engaging surfaces are in a common plane, which is conveniently substantially parallel to the frame itself. When the frame is installed, after making any required adjustments by means of the bolts 51, 53 and 54, a desired value for α is obtained by moving the bar 43 to the required position, which inclines the surfaces of the intermediate elements to the desired position determining the second plane.

In a further embodiment, a fourth drainage restricting element is included in the dewatering device, located in the gap between the riser element and the immediately preceding upstream intermediate element. In certain configurations, particularly where the inter-element spacing is chosen to be relatively large, or the value of α combined with the machine direction length of the unit provides relatively high vertical distance between the last intermediate element and the doctoring leading edge of the riser element, a significant length of the forming fabric can be exposed to vacuum assisted drainage between the point where the machine side of the forming fabric loses contact with the last intermediate element adjacent its trailing edge, and the leading doctoring edge of the riser element. This allows an excessive amount of water to be withdrawn from the stock at this point. This can be controlled by insertion of a fourth drainage restricting element in this gap, with a fabric supporting surface that is upwardly angled to be in supporting contact with the forming fabric, so that the intermediate element supporting surfaces and the drainage restricting element supporting surface form a shallow "V" which supports the machine side of the forming fabric, and which limits the area of the machine side of the forming fabric exposed to vacuum assisted drainage at this point.

There are several options for the construction of the additional drainage restricting element; for example:

(a) it can be unadjustably mounted, more or less as described above for the other elements; or (b) it can be adjustably mounted; or (c) it can be adjustably mounted onto a subframe supporting a set of intermediate elements.

For the same reasons as set out above for the intermediate elements, it is preferred that the additional drainage restricting element is adjustably mounted. More preferably, more or less the same subframe assembly as that described for the intermediate elements is used for the additional drainage restricting element.

Figure 14:
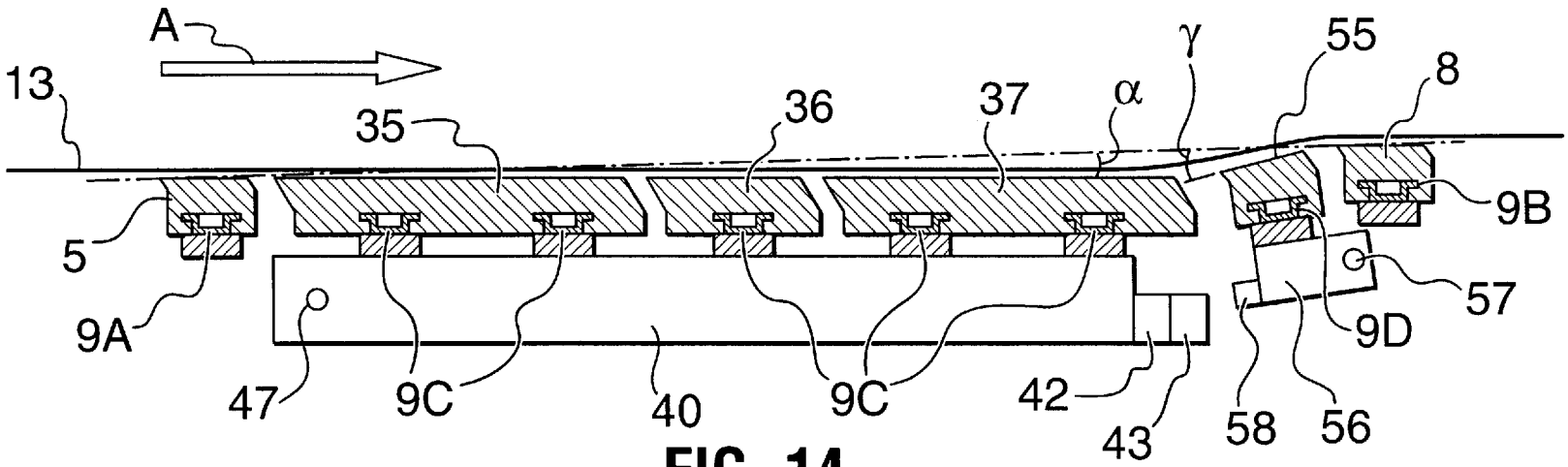
FIG. 14 shows schematically a cross section in the machine direction of a stock turbulence generating unit in accordance with a third embodiment of the present invention.

In FIG. 14 is shown a schematic cross section embodying a drainage restriction element. The lead-in and riser elements 5 and 8 are supported by their T-bars 9A and 9B. The three intermediate elements 35, 36 and 37 are each supported by T-bars 9C carried on the first subframe 40. The first subframe 40 is supported at its upstream end by the rod 47, about which it rotates to provide the required value for $\alpha$. It is supported at its downstream end by the adjustment assembly 42 and the adjusting bar 43. The actual value for $\alpha$ is determined by the position of the adjustment bar 43 relative to the vertical adjustment assembly 42. The drainage restriction element 55 is supported by a T-bar 9D carried by a second subframe 56, which is rotatably supported at its downstream end (in much the same fashion as the first subframe 40) by the rod 57. The angular position of the drainage restriction element, indicated by the angle $\gamma$ between the surface 61 and the first plane, is controlled by the vertically adjustable upstream mounting 58 for the second subframe 56. A similar arrangement to that described for the first subframe is conveniently used. In most cases, the angles $\beta$ and $\gamma$ will be more or less the same.

Figure 15:
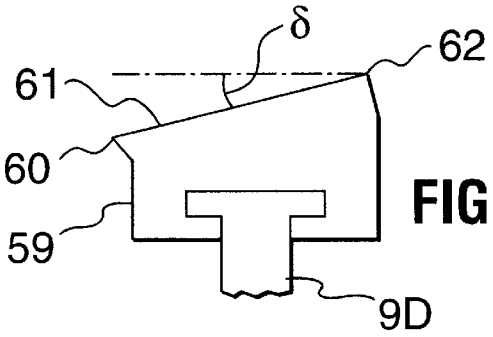
FIG. 15 shows a cross section of the drainage restriction element shown in FIG. 14.

The cross section of the drainage restriction element is shown in FIG. 15. The upstream face 59 includes a doctoring leading edge 60, which is followed by an upwardly inclined surface 61, which terminates in a trailing edge 62. The element is suitably supported by a T-bar as at 9D. The value of the angle $\delta$ is chosen to allow a value for the angle $\gamma$ which provides a smooth transition of the moving forming fabric from the locus at which it loses contact with the last intermediate element 37 onto the inclined surface of the riser element 8. Depending on the form of mounting used for the drainage restriction element, the angle $\delta$ can be quite small, and can be zero, so that the upwardly inclined surface is substantially perpendicular to the upstream face 59. As noted above, the point at which the forming fabric loses contact with the element 37 depends inter alia on the level of vacuum applied to the dewatering box.

Figure 16:
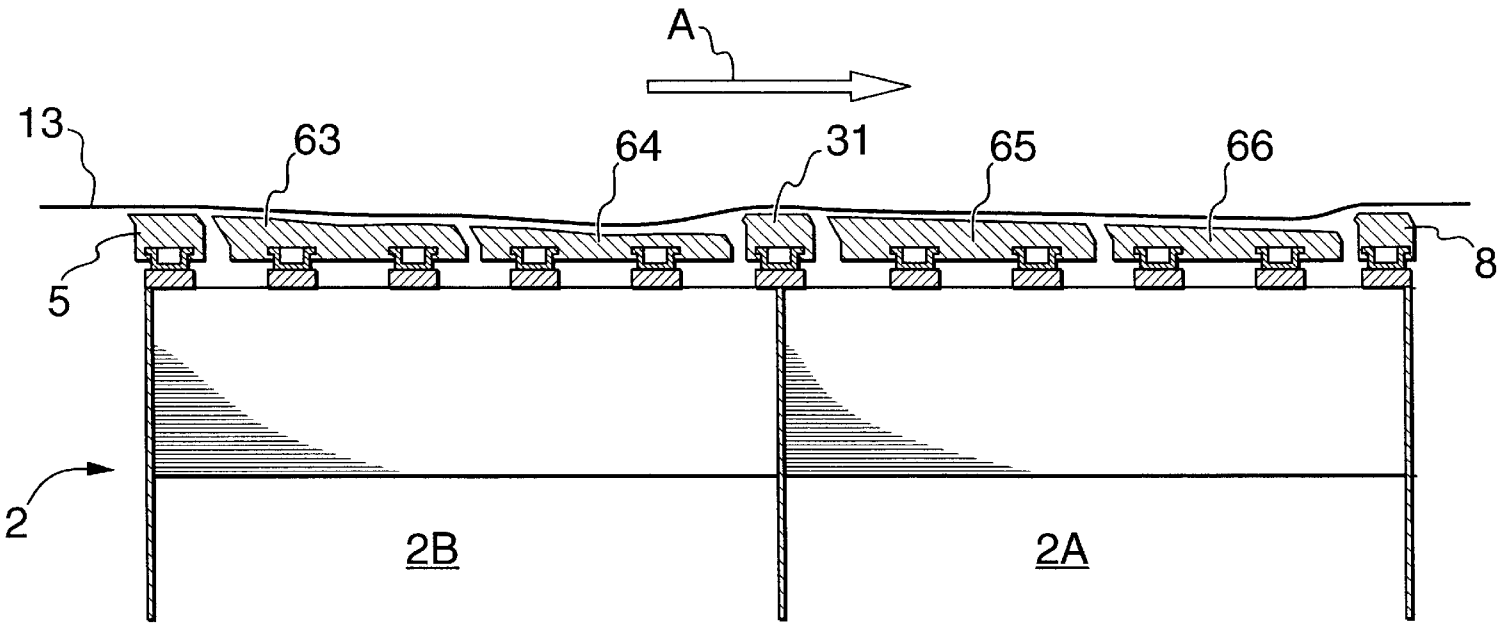
FIG. 16 shows alternative intermediate element arrangements applicable to FIGS. 1, 7 and 14 including agitator blade profiles for the intermediate elements.

FIG. 16 shows schematically alternative intermediate element profiles to those shown in FIGS. 1, 7 and 14. FIG. 16 shows a seven element set. The first set of elements comprises a lead-in element 5, and two intermediate elements 63, 64 each of which have an agitator blade profile. The central element 31 is both riser element for the first set, and lead-in element for the second set. The second set comprises two intermediate elements 65 and 66, followed by a riser element 8. The elements 65 and 66 have a substantially planar surface. As shown, the two sets are placed over a divided dewatering box. 2 with separate drainage spaces 2A and 2B to which the same, or a different, level of vacuum can be applied. It is also contemplated that the elements 63 and 64 can form the second set, with elements 65 and 66 forming the first set. From this it can be seen that combinations of element profiles can be used to generate a desired level of turbulence within the stock.

The present invention provides a number of advantages over the prior art. The stock turbulence generating unit can be used to advantage to dewater and deflocculate thick and/or heavy grade stocks while applying low vacuum pressure, or, in some circumstances, minimal vacuum once the section is operating. The ability to diminish the applied level of vacuum significantly reduces drainage and sheet sealing during passage of the stock over the unit. The turbulence generated throughout the stock thickness can also be used to enhance the even and efficient deflocculation of the stock by other agitation devices located both upstream and downstream of the unit.

We claim:

1. Apparatus for generating turbulence in the stock on a forming fabric in an open surface forming section of a paper making machine, the forming section including a relatively slowly moving forming fabric having a paper side and a machine side, a relatively thick stock layer on the paper side thereof, a dewatering box means located beneath the forming fabric connected to a controlled vacuum supply means operable to create a reduced pressure within the dewatering box, and a plurality of forming fabric supporting dewatering elements carried by the dewatering box consisting essentially of:

(i) a lead-in dewatering element having a fabric supporting surface comprising in sequence:
a doctoring leading edge;
a substantially horizontal intermediate surface; and
a declining trailing surface;

(ii) a riser dewatering element having a fabric supporting surface comprising in sequence
a doctoring leading edge;
an inclined surface;
an exit surface; and
a portion comprising the junction of the inclined and exit surfaces; and (iii) at least one intermediate dewatering element located between the lead-in dewatering element and the riser element and spaced from each other dewatering element by a gap, the or each intermediate element having
a fabric supporting surface comprising in sequence:
a doctoring leading edge;
a declining surface; and
a trailing edge;
wherein:

(a) the portion of the riser element located at the junction of the inclined and exit surfaces is chosen from an apex at the junction of the inclined surface and the exit surface, a short substantially horizontal surface linking the inclined surface and the exit surface, and a curved surface linking the inclined surface and the exit surface;

(b) the intermediate surface of the lead-in dewatering element, and the portion of the riser element comprising the junction of the inclined and exit surfaces define a first plane;

(c) the declining trailing surface of the lead-in dewatering element and the declining surface of the or each intermediate dewatering element(s) define a second plane inclined at a pre-selected downward trailing angle with respect to the first plane; and (d) the doctoring leading edge of the riser element is located above the trailing edge of the adjacent intermediate dewatering element, such that movement of the forming fabric from the trailing edge of the adjacent intermediate dewatering element to the doctoring leading edge of the riser element results in a vertical movement of the forming fabric, and of the incipient paper web and the stock carried thereon.

2. Apparatus according to claim 1 wherein the at least one intermediate dewatering element located between the lead-in dewatering element and the riser element and spaced from each other dewatering element by a gap, is adjustably attached to the dewatering box permitting location of the or each declining surface thereof in the desired second plane, and permitting movement to a different desired second plane.

3. Apparatus according to claim 2 including a plurality of intermediate elements attached to a first subframe adjustably attached to the dewatering box.

4. Apparatus according to claim 1 further including a drainage restricting element, which is interposed between the riser element and the adjacent intermediate element, having a fabric supporting surface comprising in sequence:

a doctoring leading edge; and an upwardly inclined surface;

wherein the attachment of the drainage restricting element to the dewatering box is constructed and arranged to locate the upwardly inclined surface at an angle to the second plane so as to provide a shallow "V" angle therebetween conforming to the inclined surface of the riser element.

5. Apparatus according to claim 2 further including a drainage restricting element, which is interposed between the riser element and the adjacent intermediate element, having a fabric supporting surface comprising in sequence:

a doctoring leading edge; and an upwardly inclined surface;

wherein the attachment of the drainage restricting element to the dewatering box is constructed and arranged to locate the upwardly inclined surface at an angle to the second plane so as to provide a shallow "V" angle therebetween conforming to the inclined surface of the riser element.

6. Apparatus according to claim 3 further including a drainage restricting element, which is interposed between the riser element and the adjacent intermediate element, having a fabric supporting surface comprising in sequence:

a doctoring leading edge; and an upwardly inclined surface;

wherein the attachment of the drainage restricting element to the dewatering box is constructed and arranged to locate the upwardly inclined surface at an angle to the second plane so as to provide a shallow "V" angle therebetween conforming to the inclined surface of the riser element.

7. Apparatus according to claim 4 wherein the attachment of the drainage restricting element to the dewatering box is chosen from the group consisting of a fixed attachment, and an adjustable attachment.

8. Apparatus according to claim 5 wherein the attachment of the drainage restricting element to the dewatering box is chosen from the group consisting of a fixed attachment, and an adjustable attachment.

9. Apparatus according to claim 6 wherein the attachment of the drainage restricting element to the dewatering box is chosen from the group consisting of a fixed attachment, an adjustable attachment, and a second adjustable attachment incorporated into a first adjustable attachment for the intermediate elements.

10. Apparatus according to claim 1 wherein all of the intermediate fabric supporting elements are of the same width in the machine direction.

11. Apparatus according to claim 1 wherein all of the intermediate fabric supporting elements are not of the same width in the machine direction.

12. Apparatus according to claim 2 wherein all of the intermediate fabric supporting elements are of the same width in the machine direction.

13. Apparatus according to claim 2 wherein all of the intermediate fabric supporting elements are not of the same width in the machine direction.

14. Apparatus according to claim 4 wherein all of the intermediate fabric supporting elements are of the same width in the machine direction.

15. Apparatus according to claim 4 wherein all of the intermediate fabric supporting elements are not of the same width in the machine direction.

16. Apparatus according to claim 1 wherein the or each intermediate fabric supporting element has a substantially flat declining surface.

17. Apparatus according to claim 1 wherein at least one intermediate element has an agitator blade profile.

18. Apparatus according to claim 2 wherein the or each intermediate fabric supporting element has a substantially flat declining surface.

19. Apparatus according to claim 2 wherein at least one intermediate element has an agitator blade profile.

20. Apparatus according to claim 3 wherein the or each intermediate fabric supporting element has a substantially flat declining surface.

21. Apparatus according to claim 3 wherein at least one intermediate element has an agitator blade profile.

22. Apparatus according to claim 1 wherein the downward trailing angle between the first and the second plane is from about 0.25° to about 10°.

23. Apparatus according to claim 2 wherein the downward trailing angle between the first and the second plane is from about 0.25° to about 10°.

24. Apparatus according to claim 3 wherein the downward trailing angle between the first and the second plane is from about 0.25° to about 10°.

25. Apparatus according to claim 1 wherein the downward trailing angle between the first and the second plane is less than about 6°.

26. Apparatus according to claim 2 wherein the downward trailing angle between the first and the second plane is less than about 6°.

27. Apparatus according to claim 3 wherein the downward trailing angle between the first and the second plane is less than about 6°.

28. Apparatus according to claim 1 wherein the downward trailing angle between the first and the second plane is from about 2° to about 4°.

29. Apparatus according to claim 2 wherein the downward trailing angle between the first and the second plane is from about 2° to about 4°.

30. Apparatus according to claim 3 wherein the downward trailing angle between the first and the second plane is from about 2° to about 4°.

31. Apparatus according to claim 1 including first and second turbulence generating apparatuses in sequence, with the exit surface of the riser element of the first apparatus providing the lead-in element trailing surface of the second apparatus.

32. Apparatus according to claim 31 including a single dewatering box supporting both turbulence generation apparatuses.

33. Apparatus according to claim 31 including a dewatering box with a first and a second hydraulically separate compartment, each of which have their own vacuum supplies, each of which compartments supports one turbulence generating apparatus.

34. Apparatus according to claim 31 wherein the angle between the first and second plane in the first turbulence generating apparatus is the same as the angle between the first and second plane in the second turbulence generating apparatus.

35. Apparatus according to claim 31 wherein the angle between the first and second plane in the first turbulence generating apparatus is not the same as the angle between the first and second plane in the second turbulence generating apparatus.

36. An apparatus according to claim 1 wherein the forming fabric is moving at less than about 400 m/min.

37. An apparatus according to claim 2 wherein the forming fabric is moving at less than about 400 m/min.

38. An apparatus according to claim 3 wherein the forming fabric is moving at less than about 400 m/min.

39. An apparatus according to claim 1 including only one intermediate element.

40. An apparatus according to claim 1 including at least two intermediate elements.

41. An apparatus according to claim 2 including only one intermediate element.

42. An apparatus according to claim 2 including at least two intermediate elements.

43. An apparatus according to claim 3 including at least two intermediate elements.

44. A method for creating a desired level of turbulence in a stock layer carried on a forming fabric in an open surface forming section of a papermaking machine, consisting essentially of moving the forming fabric carrying the stock over at least one dewatering box means carrying a plurality of fabric supporting elements beneath, and in supportive contact with, the forming fabrics and applying a controlled vacuum supply to create a controlled reduced pressure in the dewatering box, the dewatering fabric supporting elements consisting essentially of:

(i) a lead-in dewatering element having a fabric supporting surface comprising in sequence:
a doctoring leading edge;
a substantially horizontal intermediate surface; and
a declining trailing surface;

(ii) a riser dewatering element having a fabric supporting surface comprising in sequence
a doctoring leading edge;
an inclined surface;
a exit surface; and
a portion comprising the junction of the inclined and exit surfaces; and (iii) at least one intermediate dewatering element located between the lead-in dewatering element and the riser element and spaced from each other dewatering element by a gap, the or each intermediate element having a fabric supporting surface comprising in sequence:
a doctoring leading edge;
a declining surface; and
a trailing edge;
wherein:

(a) the portion of the riser element located at the junction of the inclined and exit surfaces is chosen from an apex at the junction of the inclined surface and the exit surface, a short substantially horizontal surface linking the inclined surface and the exit surface, and a curved surface linking the inclined surface and the exit surface;

(b) the intermediate surface of the lead-in dewatering element, and the portion of the riser element comprising the junction of the inclined and exit surfaces define a first plane;

(c) the declining trailing surface of the lead-in dewatering element and the declining surface of the or each intermediate dewatering element(s) define a second plane inclined at a pre-selected downward trailing angle with respect to the first plane; and (d) the doctoring leading edge of the riser element is located above the trailing edge of the adjacent intermediate dewatering element, such that movement of the forming fabric from the trailing edge of the adjacent intermediate dewatering element to the doctoring leading edge of the riser element results in a vertical movement of the forming fabric, and of the incipient paper web and stock carried thereon.

45. A method according to claim 44 wherein the desired level of turbulence is created and controlled by at least one adjustable intermediate dewatering element located between the lead-in dewatering element and the riser element which is adjustably attached to the dewatering box permitting location of the or each declining surface thereof in the second plane; and the level of turbulence is controlled by adjusting the adjustable intermediate supporting element to a desired second plane location.

46. A method according to claim 45 wherein the apparatus further includes a drainage restricting element, which is interposed between the riser element and the adjacent intermediate element, having a fabric supporting surface comprising in sequence:

a doctoring leading edge; and an upwardly inclined surface;

wherein the attachment of the drainage restricting element to the dewatering box is constructed and arranged to locate the upwardly inclined surface at an angle to the second plane so as to provide a shallow "V" angle therebetween in conformance with the inclined surface of the riser element.

47. A method according to claim 46 wherein the desired level of turbulence is created and controlled by:

(i) at least one adjustable intermediate dewatering element located between the lead-in dewatering element and the riser element which is adjustably attached to the dewatering box permitting location of the or each declining surface thereof in the second plane; and (ii) a drainage restricting element, which is interposed between the riser element and the adjacent intermediate element, having a fabric supporting surface comprising in sequence:
a doctoring leading edge; and
an adjustable upwardly inclined surface;
wherein the level of turbulence is controlled by:

(a) adjusting the adjustable intermediate supporting element to a desired second plane location; or (b) adjusting the drainage restricting element to a different location; or (c) adjusting both the adjustable intermediate supporting element to a desired second plane location, and adjusting the drainage restricting element to a different location.

48. The method of claim 44 wherein said fabric moves at a speed equal to or less than about 400 m/min.

49. The method of claim 45 wherein said fabric moves at a speed equal to or less than about 400 m/min.

50. The method of claim 46 wherein said fabric moves at a speed equal to or less than about 400 m/min.

* * * * *